United States Patent [19]

Hasegawa et al.

[11] 3,982,395

[45] Sept. 28, 1976

[54] EXHAUST SYSTEM FOR MULTI-CYLINDER INTERNAL COMBUSTION

[75] Inventors: Kohichi Hasegawa, Mishima; Toshiaki Konomi, Susono, both of Japan

[73] Assignee: Toyota Jidosha Kogyo Kabushiki Kaisha, Toyota, Japan

[22] Filed: June 16, 1975

[21] Appl. No.: 587,052

[30] Foreign Application Priority Data

Feb. 10, 1975 Japan ..... 50-17867[U]

[52] U.S. Cl. ..... 60/278; 123/119 A

[51] Int. Cl.[2] ..... F02M 25/06

[58] Field of Search ..... 123/119 A; 60/278

[56] References Cited

UNITED STATES PATENTS

| | | | |
|---|---|---|---|
| 3,776,207 | 12/1973 | Simko | 123/119 A |
| 3,789,807 | 2/1974 | Pinkerton | 60/278 |

*Primary Examiner*—Wendell E. Burns

*Attorney, Agent, or Firm*—Stevens, Davis, Miller & Mosher

[57] ABSTRACT

An exhaust system for multi-cylinder internal combustion engines, which is directed to the so-called proportional exhaust gas recirculation (EGR) for improving engine exhausts. The system comprises an exhaust gas recirculating circuit connected to one engine cylinder for recirculating to an intake pipe of the engine the entire amount of exhaust gas which is discharged from said one engine cylinder. Switching means is provided in said exhaust gas recirculating circuit for switching the flow of the recirculating exhaust gas in response to a value of a predetermined parameter indicating particular operating conditions of said engine. Heat exchanging means is provided in said exhaust gas recirculating circuit in contact with said intake pipe of the engine for heating said intake pipe by heat exchange with hot exhaust gas flowing through said exhaust gas recirculating circuit, and a reactor is provided in the exhaust pipe of the engine for receiving for cleaning purposes the entire amount of exhaust gases which are discharged from engine cylinders other than said one engine cylinder.

5 Claims, 5 Drawing Figures

EXHAUST SYSTEM FOR MULTI-CYLINDER INTERNAL COMBUSTION

BACKGROUND OF THE INVENTION

This invention generally relates to exhaust systems of internal combustion engines, and more particularly to an engine exhaust cleaning device.

Emissions of engine exhausts containing CO as well as HC and $NO_x$ which are considered as sources of photochemical smogs are now under severe restrictions. As is well known, CO is generated by incomplete combustion of carbons which occurs due to lack of oxygen. This is to say, the amount of CO in the engine exhausts can be reduced by burning in the engine a lean air-fuel mixture or a combustible mixture having a high air ratio. In this connection, it has been proposed to provide a riser or the like in the exhaust pipe of the engine to heat a lean air-fuel ratio mixture for the purpose of attaining complete combustion of the fuel without misfiring to reduce the amount of CO in the engine exhausts.

It has also been proposed to provide a reactor upstream of an exhaust pipe for accelerating oxidation reactions of CO as well as HC which has remained unburned due to low temperatures prevailing in the vicinity of combustion chamber walls, thereby converting them into unharmful forms of $H_2O$ and $CO_2$.

On the other hand, if the combustion in the combustion chambers of the engine is effected at an excessively high level, a large amount of NO is produced, changing into $NO_2$ upon contact with air. The combustion temperature may be lowered by introducing an inert gas into the combustion chambers for heat absorption. In this connection, it has already been proposed to recirculate a portion of the exhaust gas from the exhaust pipe to the intake pipe of the engine by the so-called exhaust gas recirculating (EGR) system.

However, the existing EGR systems are usually adapted to recirculate a portion of exhaust gas of each cylinder in a multi-cylinder internal combustion engine and therefore have a drawback in that the EGR rate (amount of recirculated exhaust gas/ (amount of recirculated exhaust gas + intake air amount)) becomes smaller with a cylinder of a larger piston displacement, allowing temperature rises and producing $NO_x$ in an increased degree. In order to reduce the amount of $NO_x$ efficiently without deteriorating the performance of the vehicle, it is desirable to recirculate the exhaust gases in proportion to the amount of intake air of the engine. However, the proportional EGR has thus far been possible only with a complicate correcting or adjusting device.

With the conventional devices of this nature, the unrecirculated portion of the exhaust gases which have been deprived of heat in a riser or the like is released into the air without undergoing sufficient reactions in the reactor, thus precluding complete cleaning of the exhaust gases,

SUMMARY OF THE INVENTION

It is an object of the present invention to provide a proportional EGR type exhaust gas cleaning device for internal combustion engines, which is capable of recirculating exhaust gases in proportion to the amount of intake air of the engine.

It is another object of the invention to provide an exhaust gas cleaning device of the type mentioned above, which can eliminate emissions of exhaust gases which contain incomplete combustion products.

It is a further object of the invention to provide an exhaust gas cleaning device having an improved reactor.

In a preferred form of the invention, the exhaust system for multi-cylinder internal combustion engines comprises in combination: an exhaust gas recirculating circuit connected to one engine cylinder for recirculating to an intake pipe of the engine the entire amount of exhaust gas which is discharged from said one cylinder, switching means provided in said exhaust gas recirculating circuit for switching the flow of the recirculating exhaust gas in response to a value of a predetermined parameter indicating particular operating conditions of the engine, heat exchanging means provided in said exhaust gas recirculating circuit in contact with said intake pipe of the engine for heating said intake pipe by heat exchange with hot exhaust gas flowing through said exhaust gas recirculating circuit, and a reactor provided in the exhaust pipe of the engine for receiving for cleaning purposes the entire amount of exhaust gases which are discharged from engine cylinders other than said one engine cylinder.

The above and other objects, features and advantages of the invention will become clear from the following particular description and the appended claims, taken in conjunction with the accompanying drawing which shows by way of example a preferred embodiment of the invention.

Figure 1:
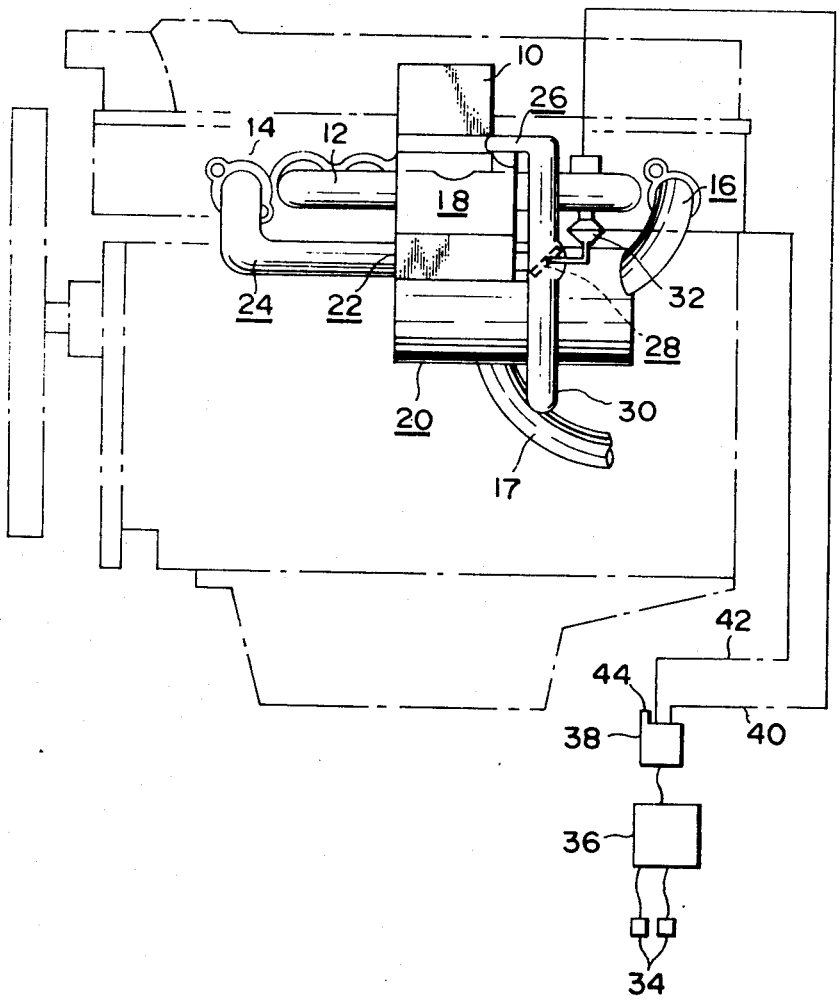
FIG. 1 is a diagrammatic side elevation showing the exhaust gas cleaning device of the invention as mounted on a multi-cylinder internal combustion engine.
Figure 2:
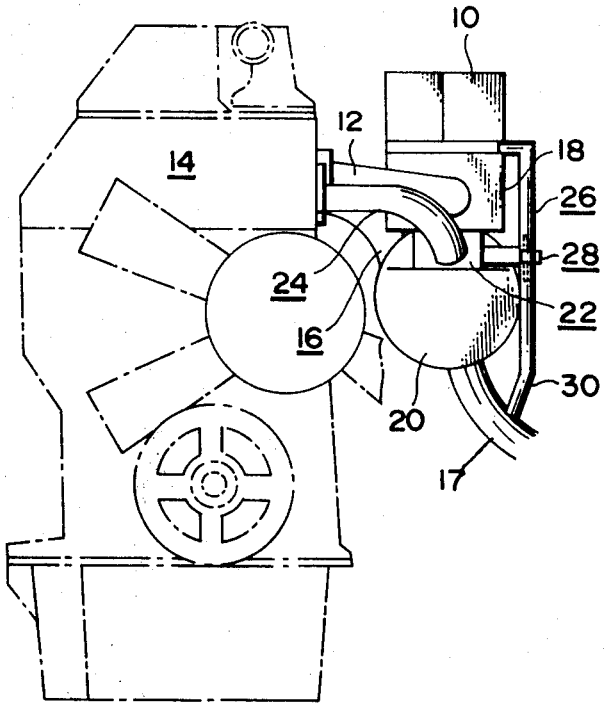
FIG. 2 is a diagrammatic front elevation of the exhaust gas cleaning device of FIG. 1.
Figure 3:
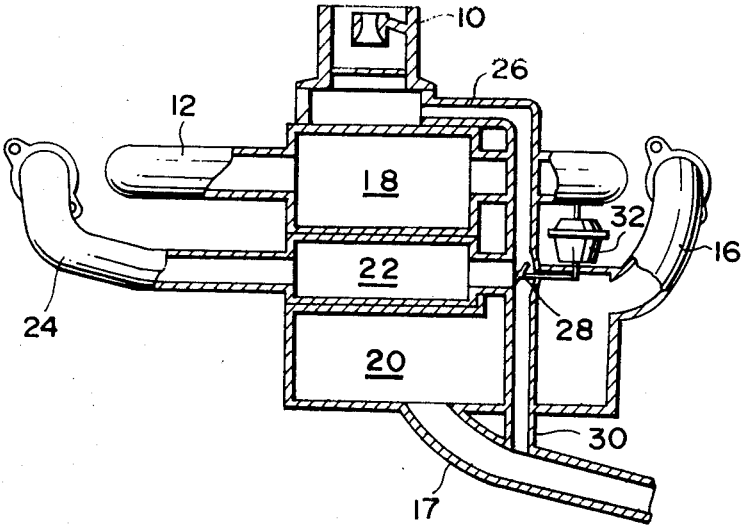
FIG. 3 is a sectional side elevation of the exhaust gas cleaning device of FIG. 1.
Figure 4:
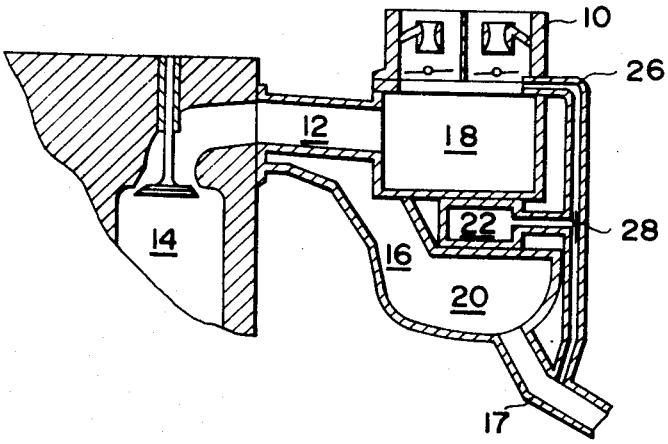
FIG. 4 is a sectional front elevation of the exhaust gas cleaning device of FIG. 1.

PARTICULAR DESCRIPTION OF THE INVENTION:

Referring to FIGS. 1 and 2 of the accompanying drawing, the engine exhaust gas cleaning device of the invention is shown as being mounted on a multi-cylinder internal combustion engine 14 which includes a carburetor 10, an intake manifold 12 and an exhaust manifold 16. The combustible air-fuel mixture is supplied from the carburetor 10 to the engine 14 and, after being burned in the combustion chamber of the engine, discharged into the atmosphere through the exhaust manifold 16. A heat riser 18 is interposed between the carburetor 10 and the intake manifold 12 for heating the air-fuel mixture to be supplied to the engine, thereby accelerating vaporization of the fuel. This contributes to prevent the air-fuel mixture from getting too lean and to reduce emissions of Co and HC. A reactor 20 is provided in a suitable position within the length of the exhaust manifold 16 for accelerating oxidation reactions of CO and HC for conversion into $CO_2$ and $H_2O$ before they are discharged out of the exhaust system. The heat riser 18 has in its lower portion a heat exhanger 22 for heating the same. An exhaust pipe 24 of one engine cylinder is connected to the heat exchanger 22 for introducing thereinto hot EGR gas for heat exchange with air-fuel mixture to be supplied to the engine. The EGR gas which has been cooled off by the heat exchange is recirculated through an EGR passage 26 to the intake pipe 12 between the carburetor 10 and the riser 18. This circuit will be referred to hereinafter as EGR circuit for the convenience of explanation. Upon introducing the inert gas (exhaust gas) into the combustion chambers of the engine along with the air-fuel mixture, the temperature of the combustion chamber is lowered to a level suitable for effectively suppressing production of $NO_x$ which would be generated in high temperature combustion. In this instance, the exhaust gas from one engine cylinder is entirely recirculated to the intake manifold, that is to say, the EGR is effected in proportion to the amount of the intake air, without causing engine power failures or misfiring which would invite emission of HC in a large amount. On the other hand, it is also possible to prevent production of $NO_x$ which occurs in a large amount when the amount of EGR is too small. As the hot exhaust gas is cooled off suitably while being passed through the heat exchanger, it has the least possibility of giving adverse effects on the intake system, or causing thermal damages to the change-over valve of the like and percolations of carburetor. The exhaust gas from one cylinder of the engine is, after being used for heating the riser and cooled off in the heat exchanger, entirely recirculated to the intake pipe without discarding to the atmosphere a portion of the cooled exhaust gas which would be susceptible to of sufficient reaction in the reactor. On the other hand, the exhaust gases from other engine cylinders are not recirculated and are left in a hot state to undergo satisfactory combustion reactions in the reactor. Moreover, since it suffices to connect to the reactor the engine cylinders except for the one which is used for EGR, the reactor may be have a short length, that is to say, to have a small ratio of surface area to volume or to have a compact construction with high heat retaining effect.

Figure 5:
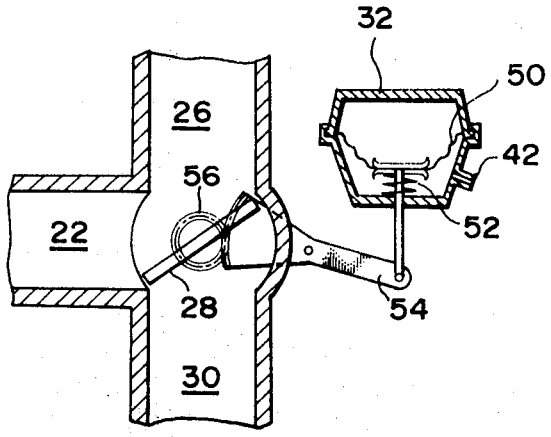
FIG. 5 is an enlarged sectional view of the changeover valve used for the exhaust gas cleaning device of FIG. 1.

However, the EGR is not required under certain operating conditions of the engine, for example, with a cold engine or during high engine power operations. In this connection, in order to switch the flow of the EGR gas, a change-over valve 28 is provided at the inlet end of the EGR passage 26 for discharging, when unnecessary, the exhaust gas through an exhaust passage 30 to the exhaust pipe 16. The change-over valve 28 is connected, for example, to a switching means or actuator 32 in the form of a diaphragm device for operating the change-over valve 28 with the aid of intake manifold vacuum. The switching means may further include, for example, a number of sensors 34 which are adapted to detect predetermined parameters such as temperatures of radiator water, engine lubricant oil, intake manifold vacuum, vehicle speed and the like and which are connected through a computer 36 to a change-over valve 36 which is, for example, in the form of an electromagnetic valve. More particularly, where detection of the temperature of radiator water is involved, the water temperature is detected by the sensor 34 and the computer 36 actuates the electromagnetic change-over valve 38 to supply intake manifold vacuum from a vacuum passage 40 to a passage 42 when the detected water temperature is higher than a predetermined value. As a result, a diaphragm 50 of the actuator 32 is moved downwardly in FIG. 5 over a spring 52, rotating a sector gear 54 in the clockwise direction, in turn, a gear 56 in the anti-clockwise direction, along with the change-over valve 28, thereby allowing the exhaust gas from the heat exchanger 22 to enter the EGR passage 26 to effect the proportional EGR. In case the detected water temperature of the radiator is lower than the predetermined value, the computer 36 produces a signal to de-energize the electromagnetic valve 38, communicating the vacuum passage 42 with an atmospheric air inlet port 44, so that the diaphragm 50 is moved upwardly under the influence of the return spring 52, rotating the sector gear 54 in the anti-clockwise direction, in turn, the change-over valve 28 in the clockwise direction, communicating the outlet of the heat exchanger 22 with the exhaust passage 30, so that the exhaust gas is not recirculated but discharged to the atmosphere. In this manner, the EGR is automatically suspended when the temperature of the radiator water or the engine is low enough and there is less possibility of producing $NO_x$, for the purpose of increasing the engine power.

What is claimed is:

1. An exhaust system for a multi-cylinder internal combustion engine, comprising:

an exhaust gas recirculating circuit connected to an exhaust pipe of one engine cylinder for recirculating to an intake manifold of the engine the entire amount of exhaust gas which is discharged from said one engine cylinder;

switching means provided in said exhaust gas recirculating circuit for switching the flow of the recirculating exhaust gas in response to a value of a predetermined parameter indicating particular operating conditions of said engine;

heat exchanging means provided in said exhaust gas recirculating circuit in contact with said intake manifold of said engine for heating said intake manifold by heat exchange with said recirculating exhaust gas; and a reactor provided in the exhaust manifold of said engine for receiving for cleaning purposes the entire amount of exhaust gases which are discharged from engine cylinders other than said one engine cylinder.

2. An exhaust system as defined in claim 1, wherein said heat exchanging means is provided on a lower side of a heat riser which is located between a carburetor and said intake manifold of said engine.

3. An exhaust system as defined in claim 1, wherein said exhaust gas recirculating circuit includes an exhaust gas recirculating passage and an exhaust passage at the outlet end of said heat exchanging means, and said switching means includes a change-over valve mounted at said outlet end of said heat exchanging means, and an actuator operatively connected to said change-over valve for switching the position of said change-over valve in response to predetermined operating conditions of said engine.

4. An exhaust system as defined in claim 3, wherein said actuator is in the form of a diaphragm device operative to switch the position of said change-over valve with aid of intake manifold vacuum of said engine.

5. An exhaust system as defined in claim 4, wherein said actuator is in communication with said intake manifold vacuum of said engine through a second change-over valve, said second change-over valve being under control of a computer which is connected to a sensor for operating said change-over valve in response to predetermined operating conditions of said engine.

* * * * *